US006045457A

United States Patent [19]

Soong

[11] Patent Number: 6,045,457

[45] Date of Patent: Apr. 4, 2000

[54] GOLF CLUB SHAFT WITH AN INNER MEMBER

[76] Inventor: Tsai C. Soong, 1839 Jackson Rd., Penfield, N.Y. 14526

[21] Appl. No.: 09/015,890

[22] Filed: Jan. 30, 1998

Related U.S. Application Data

[63] Continuation-in-part of application No. 08/931,569, Sep. 16, 1997.

[51] Int. Cl.[7] ..... A63B 53/10; A63B 53/12

[52] U.S. Cl. ..... 473/318; 473/323

[58] Field of Search ..... 473/316–323, 473/219, 239, 295–299, 564–567, 520–521, 523, 524

[56] References Cited

U.S. PATENT DOCUMENTS

| | | | |
|---|---|---|---|
| 1,212,038 | 1/1917 | Flaxman | 473/44 |
| 1,499,128 | 6/1924 | Shroyer | 473/519 |
| 4,214,395 | 7/1980 | Caldwell | 43/18.1 |
| 5,219,164 | 6/1993 | Peng | 473/520 |
| 5,575,722 | 11/1996 | Saia | 473/300 |
| 5,683,308 | 11/1997 | Monette | 473/318 |

*Primary Examiner*—Jeanette Chapman
*Assistant Examiner*—Stephen L. Blau
*Attorney, Agent, or Firm*—Bernard A. Chiama

[57] ABSTRACT

The golf club according to the invention consists, besides a grip and a head, of a compound shaft which has at least an outer shaft defining a hollow portion, a head end, a head end section, a grip end section and a butt end; and an inner shaft partially disposed within the hollow portion of the outer shaft, wherein the inner shaft has a fixed first end region, a second end region, and an intermediate section. During bending of the golf club shaft, at least the second end region of the inner shaft engages the inner surface of the outer shaft, and that at least a portion of the intermediate section has clearance with the inner surface of the outer shaft when the outer shaft is not in bending. A higher frequency mode of vibration is formed when the shaft is in bending.

7 Claims, 2 Drawing Sheets

GOLF CLUB SHAFT WITH AN INNER MEMBER

This is a Continuation-In-Part of application Ser. No. 08/931,569, filed Sep. 16, 1997, which has been allowed.

BACKGROUND OF THE INVENTION

The shaft of a conventional golf club having a heavy head invariably bends in a so-called primary frequency mode in mechanics when it is being swung. A typical bent shape is shown in FIG. 1 wherein 1 is the shaft, 51 the butt end, 51 to 5 is a rigid portion, 3 the head end, 4 the swing load at the head, 7 the rubber grip, and 8 is where the grip ends. Grip is a covering of the handle part of a golf club shaft which is about 25 cm in length, but only about the first 20 cm is being used to hold by a typical player. Grip is meant here as the handle part, about 20 cm of the shaft, where the hand actually holds. From end points 51 to 3, the shaft forms a downward bending curve. The time required for the bending shaft to finish a complete cycle of vibration is called frequency. Frequency depends on the mode which is the shape of the bending curve. The primary frequency mode is the slowest for the shaft to swing back from its maximum curved position to the straight, unstressed length again. When the shaft recovers to straight, the head should hit the stationary ball at the tee. A slow recovery, and for that matter a primary frequency mode, means a slow head speed.

SUMMARY OF THE INVENTION

One of the objective of the invention is to change the vibration from a primary frequency mode into a higher frequency mode. Another objective is to enable the golfer to control the head through a pivoting point at the shaft, which is substantially closer to the head than from the grip, thereby the control is improved.

The golf club according to the invention consists of a golf club shaft which has at least an outer shaft defining a hollow portion, a head end, a head end section, a grip end section and a butt end of the grip end section; and an inner shaft apparatus generally parallel with the outer shaft and at least partially disposed within the hollow portion of the outer shaft, wherein the inner shaft apparatus has a fixed first end region, a second end region that is closer to the head end than the first end region, and an intermediate section between the first end region and the second end region, wherein the second end region is disposed between the head end and the grip end section of the outer shaft.

During bending of the golf club shaft, at least the second end region of the inner shaft apparatus engages the inner surface of the outer shaft. It is further devised that at least a portion of the intermediate section has clearance with the inner surface of the outer shaft when the outer shaft is not in bending. According to the invention, the resulting bending mode of the shaft is a higher frequency mode.

The complete golf club further consists of a head, coupled to the head end of the outer shaft; and a grip, covering the grip end section of the outer shaft.

BRIEF DESCRIPTION OF THE DRAWINGS

Figures only depict some of the preferred embodiments of the invention among all practically possible and desirable arrangements.

DESCRIPTION OF THE PREFERRED EMBODIMENTS

A golf club about conventional length and weight, having a grip, a head, and a compound shaft, comprising a smooth, straight, outer shaft, which is at least partially hollow, most likely is hollow from end to end, made of reinforced fibers or metal; and a shorter, generally concentric, inner shaft apparatus, which features the invention. The inner shaft apparatus may be hollow, partially hollow, or solid; may be made of reinforced fibers, metal, or other strong resilient materials. It is not a flexible, wire or cable like structural element. Sections with different diameter or cross sectional shapes may be joined to become said shaft. Diameter is meant as a measure of width, not necessary about circular cross sections.

Figure 2:
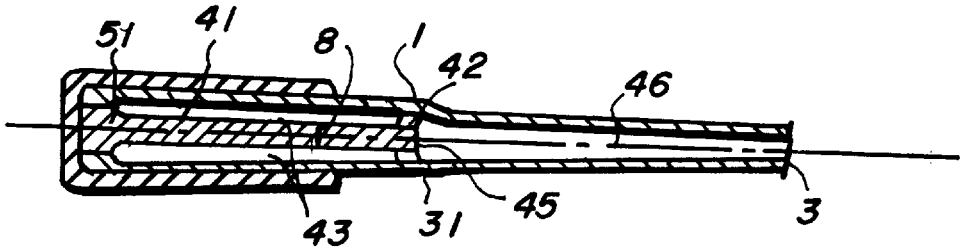
FIG. 2 shows a preferred embodiment of the invention.
Figure 5:
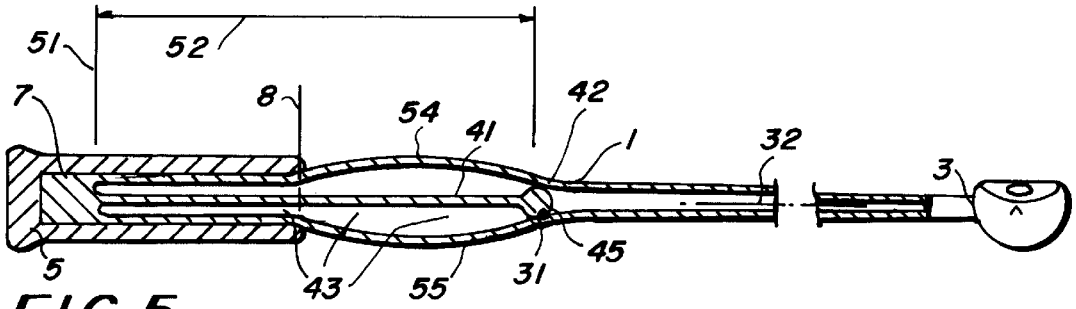
FIG. 5 shows in detail of the FIG. 2 embodiment of the invention wherein the second end region of the inner shaft apparatus is engaged to the outer shaft in the simple support manner.

FIG. 2, and the more accurately drawn FIG. 5, shows a sketch of a preferred embodiment wherein the compound shaft, having a butt end 5, comprising the outer shaft 1, and the inner shaft apparatus 41 whose first end region 51 joins the butt end of the outer shaft at 51, whose second end region 45 engages the outer shaft at a location point 31 along the axis of the shaft 33. As is shown in FIG. 5, the inner shaft apparatus engages the outer shaft in a simple support manner. The contact may be through an optional cushion 42. The contact may spread into a small region. The two shafts may have clearance 43 from point 51 to 31 which separates the two shafts. There may be cushion materials in the clearance. From end point 5 to 51, a fixed joint region exists, where the ends are rigidly joined into one piece which may include an end cap. Clearance remains unchanged when the outer shaft is not in bending. Clearance will be reduced or opposing surfaces become contact when bending is increased. Large clearance in the latter part of the inner shaft is made possible by the provision of a big bulged portion shown as 55 in FIG. 5 which begins about the end of the grip 8, peaked about point 54, and converges to zero about the junction 31 where the second end region of the inner shaft apparatus engages the outer shaft.

The reduction in diameter of the outer shaft at 31 forms a cusp like seat in the interior of the outer shaft, so that the end 45 of the inner shaft apparatus behaves as a stiff pivot point about which the outer shaft may bend freely without restraint from the inner shaft apparatus. A lateral force 33 shown in FIG. 4 due to bending, but no bending moment, is being transmitted from the inner shaft apparatus to the outer shaft at that point. Such a contact is called simple support in mechanics. It is preferred that contact is through a cushioning device 42. It is further preferred, even though not necessary, that the end 45 is always in contact with the cusp even when the shaft is not bent. Then the compound shaft may behave as a single shaft at all times.

The first end region 51 of the inner shaft apparatus does not have to join the outer shaft at its butt end 5. It may join it anywhere before or after the end of the grip 8. So is the second end region 45 which may be anywhere after the first end region.

Figure 3:
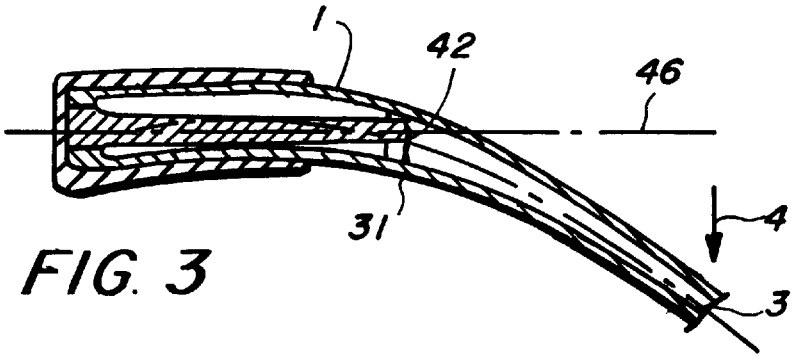
FIG. 3 shows the FIG. 2 shaft as being bent during swing of the club.

FIG. 3 shows bending of FIG. 2 shaft under head load 4 where the center line of the inner shaft which is shown as perfectly straight in bending is exaggerated. At least some slight bending deflection will occur.

Figure 4:
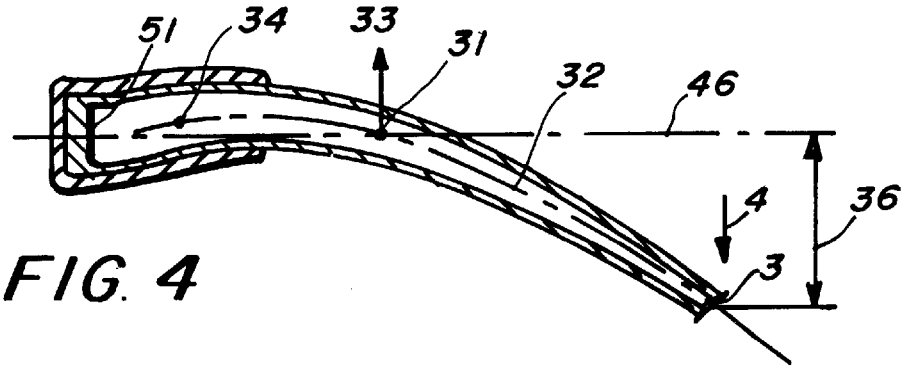
FIG. 4 shows the deflected center line of the FIG. 3 shaft under head load, having a higher frequency mode of vibration.

FIG. 4 shows the deflected center line 32 of the outer shaft. Under the interior lateral force 33 from the inner shaft apparatus, the bending moment to the outer shaft from the swing force 4 between point 51 to 31 is greatly reduced. An upward bending prevails in that portion of the outer shaft. The new deflection pattern of the outer shaft is characterized by a higher frequency mode of vibration in which, two oppositely curved portions exist: from point 51 to 34, there is an upward curved portion, which is joined by a downward curved portion from point 34 to 3, separated by the inflection point 34. This two-opposite-curve pattern is a characteristic of a higher frequency vibration mode. The compound shaft takes less time to become straight again. Therefore, the head moves faster. That is explained clearly in general mechanics theory.

Figure 1:
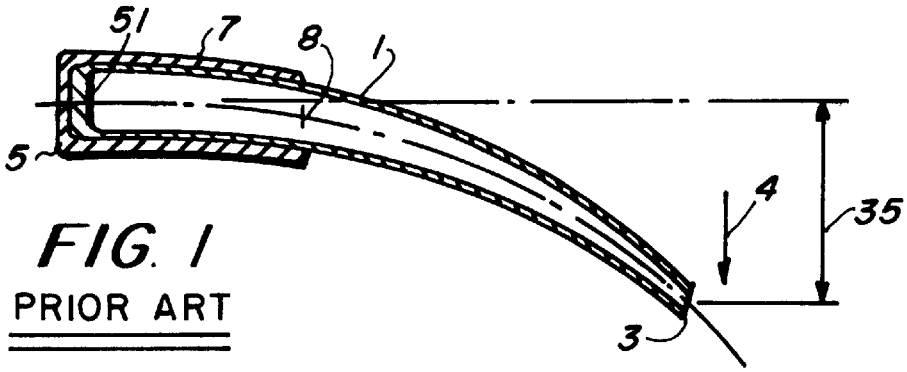
FIG. 1 PRIOR ART
FIG. 1 shows the bending of a conventional golf club having the primary frequency mode of vibration.

It is clear from FIG. 4 that if the inner shaft apparatus is stiff, the engaging point 31 at the outer shaft will be lifted up higher than before. One result is the end deflection of the head shown as 36 in FIG. 4 is less than the corresponding deflection 35 in FIG. 1. The deflection curve has more tight bends which are eager to return to straight. The golfer feels having better control with the compound shaft, because the golfer is actually driving the head through the junction arch 31, which is much closer to the head than at grip end 8 before.

If the cusp is replaced by a universal type joint or other mechanical jointing arrangement which transmits axial rotation from the head to the inner shaft, but no bending moment, the twisting of the head during impact with the ball which is transmitted to the outer shaft can be reduced, since both the inner and outer shafts are resisting the twisting torque from the eccentric head. Such joining mechanical arrangement is not difficult to make and details will not be included here.

To make the invention work, it is preferred that the pivot point 31 of the inner shaft should be substantially distanced from 8 and close to the head.

For an average player, the hand hold on a grip is about 20 cm. This is the axial distance from point 5 to 8. Field test shows the second end region 45 of the inner shaft apparatus 41 should be between 30 cm to 60 cm from point 5. Less than 30 cm and more than 60 cm do not show significant improvement.

A beam fixed at one end and simply supported at the other end will have its maximum deflection at ⅔ of its total length, away from the fixed end. This formula, with ⅙ of the total length taken as the tolerance, the center of the bulge, point 54, should be at about 50% to 83% of the length 52 of the inner shaft apparatus from point 51.

Compared to the conventional club having a shaft diameter of 15 mm, a diameter of the bulge greater than 30 mm will make the outer shaft much too stiff. Therefore, the maximum bulge diameter, or width of the cross section if it is not circular, of the outer shaft is preferred to be about from 18 to 30 mm.

Figure 6:
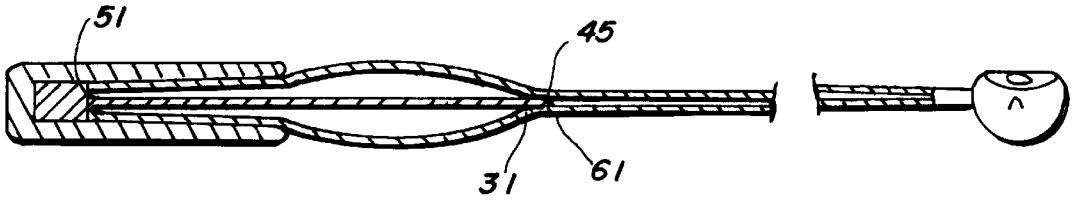
FIG. 6 shows an embodiment in which the inner shaft apparatus is engaged to the outer shaft in the fixed-end manner.

Another viable embodiment is shown in FIG. 6, wherein the end 45 of the inner shaft apparatus is engaged to the outer shaft at location 31 in a fixed-end manner; that is, the two shaft is rigidly joined together, such as glued, pinned, riveted, welded or other permanent and rigid manner, within a region between 31 to 61, so that the two shafts twist and bend together in that region. If the joining is not that rigidly and permanently enforced, and some amount of yielding may happen, the joining is called elastically restrained in mechanics. For example, if the cross section of the outer shaft at 61 bends into a slope greater than the slope of the inner shaft apparatus bent at 31, then the bending compliance front the outer shaft to the inner shaft apparatus is less than 100%. The rigidity is less than fixed-end and more than the simple support. It is an elastically restrained joint. An elastically restrained joint is very common which may be caused by material or by design.

Since the inside diameter of a golf club shaft is about 13.0 mm, and it is gradually reduced to less than about 10.0 mm at a distance of about 40 cm from the butt end, there is not much space available inside a conventional golf club for insertion of another shaft of substantial length with end gadget to manipulate the head. Therefore, the compound shaft is a bold endeavor. It maintains a two layered dual tube system for at least about the first third of the length of the club. To save weight, and for the purpose of flexibility, either layer of the tube is designed not to resist the load alone; but they are designed to be about equal in strength and also in weight, of the conventional shaft it replaced. The idea of having the inner tube pivoting the outer tube at a junction point closer to the head, and for increasing the head speed through the resulting higher frequency vibration mode, is an innovative concept.

What is claimed is:

1. A golf club shaft comprising:

(a) an outer shaft defining a hollow portion, a head end, a head end section, a grip end section and a butt end of the grip end section;

(b) an inner shaft apparatus generally parallel with the outer shaft and at least partially disposed withih the hollow portion of the outer shaft, wherein the inner shaft apparatus has a fixed first end region, a second end region that is closer to the head end than the first end region, and an intermediate section between the first end region and the second end region, wherein the second end region is disposed between the head end and the grip end section of the outer shaft, wherein during bending of the golf club shaft, at least the second end region of the inner shaft apparatus engages the inner surface of the outer shaft;

wherein at least a portion of the intermediate section has clearance with the inner surface of the outer shaft when the outer shaft is not in bending, and wherein the outer shaft includes a bulged section surrounding a part of the intermediate section of the inner shaft apparatus and a head end section between the bulged section and the head end.

2. The shaft of claim 1, wherein the average diameter of the bulged section is larger than the average diameter of the grip end section.

3. The shaft of claim 1, wherein the second end region of the inner shaft apparatus is located at about the junction between the bulged section and the head end section.

4. The shaft of claim 1, wherein the maximum diameter of the bulged section of the outer shaft is at least about 18 mm.

5. The shaft of claim 1, wherein the junction between the bulged section of the outer shaft and the head end section is at least about 30 cm from the butt end of the grip end section.

6. A golf club shaft comprising:

(a) an outer shaft defining a hollow portion, a head end, a head end section, a grip end section and a butt end of the grip end section, (b) an inner shaft apparatus which is shorter than the length of the outer shaft, generally concentric with the outer shaft and at least partially disposed within the hollow portion of the outer shaft, wherein the inner shaft apparatus has a first end region which is fixed to the grip end section of the outer shaft, a second end region that is closer to the head end than the first end region, and an intermediate section between the first end region and the second end region, wherein the second end region is disposed between the head end and the grip end section of the outer shaft, wherein at least a substantial portion of the intermediate section has uninterrupted continuous clearance with the inner surface of the outer shaft when the outer shaft is not bending;

wherein at least the second end region of the inner shaft apparatus engages the inner surface of the outer shaft by means of a pivot point about which the outer shaft may bend freely without restraint from the inner shaft apparatus, thereby improving performance of the golf club; and wherein said pivot point includes a simple support in the form of a seat in the interior of the outer shaft, so that said second end region of the inner shaft apparatus functions as a pivot coupled with said seat about which the outer shaft may bend substantially free without restraint from the inner shaft apparatus as aforesaid.

7. A golf club shaft comprising;

(a) an outer shaft defining a hollow portion, a head end, a head end section, a grip end section and a butt end of the grip end section, (b) an inner shaft apparatus which is shorter than the length of the outer shaft, generally concentric with the outer shaft and at least partially disposed within the hollow portion of the outer shaft, wherein the inner shaft apparatus has a first region which is fixed to the grip end section of the outer shaft, a second end region that is closer to the head end than the first end region, and an intermediate section between the first end region and the second end region, wherein the second end region is disposed between the head end and the grip end section of the outer shaft, wherein at least a substantial portion of the intermediate section has uninterrupted continuous clearance with the inner surface of the outer shaft when the outer shaft is not bending;

wherein the second end region of the inner shaft apparatus engages the inner surface of the outer shaft by means of a pivot point about which the outer shaft may bend freely without restraint from the inner shaft apparatus thereby improving performance of the golf club;

wherein when the outer shaft is in bending due to swinging of the golf club, a two-opposite-curve bending deflection pattern is produced in the outer shaft, characterizing a higher frequency vibration mode resulting in the fast straightening of the shaft after the initial swing, and finally resulting in having a higher head speed when the head hits the ball; and wherein the outer shaft includes a bulged section surrounding a part of the intermediate section of the inner shaft apparatus, and a head end section between the bulged section and the head end.

* * * * *